US008376773B2

(12) United States Patent
Ma

(10) Patent No.: US 8,376,773 B2
(45) Date of Patent: Feb. 19, 2013

(54) SECURITY DEVICE FOR HDMI CABLE CONNECTOR

(75) Inventor: Jian Ma, Luo Yang (CN)

(73) Assignee: Luoyang Ruiguang Movie-TV Optic-Electronic Technology Co., Ltd., Luo Yang, Henan (CN)

( * ) Notice: Subject to any disclaimer, the term of this patent is extended or adjusted under 35 U.S.C. 154(b) by 0 days.

(21) Appl. No.: 13/068,528

(22) Filed: May 12, 2011

(65) Prior Publication Data

US 2012/0184124 A1 Jul. 19, 2012

(51) Int. Cl.
*H01R 13/62* (2006.01)

(52) U.S. Cl. ..... 439/373; 439/347

(58) Field of Classification Search ..... 439/373, 439/371, 347, 133

See application file for complete search history.

(56) References Cited

U.S. PATENT DOCUMENTS 3,002,175 A * 9/1961 Rosenfeld et al. ..... 439/564
3,538,940 A * 11/1970 Graham ..... 137/271
4,121,880 A * 10/1978 Rollins et al. ..... 439/353
4,269,075 A * 5/1981 Crist et al. ..... 74/16
4,302,066 A * 11/1981 Newman et al. ..... 439/347
4,407,042 A * 10/1983 Schramme et al. ..... 16/2.1
4,652,069 A * 3/1987 Smith ..... 439/369
4,871,323 A * 10/1989 Ohsumi ..... 439/188
5,011,426 A * 4/1991 Colleran et al. ..... 439/357
5,011,427 A * 4/1991 Martin ..... 439/373
5,207,593 A * 5/1993 Bogiel ..... 439/352
5,336,107 A * 8/1994 Sheryll ..... 439/369
5,348,495 A * 9/1994 Kasden ..... 439/371
5,575,677 A * 11/1996 Buckner et al. ..... 439/373
5,655,924 A * 8/1997 Cross et al. ..... 439/373
5,766,032 A * 6/1998 LaPointe et al. ..... 439/371
5,928,023 A * 7/1999 Buckner et al. ..... 439/373
6,056,580 A * 5/2000 Cross et al. ..... 439/369
6,071,142 A * 6/2000 Blackman ..... 439/373
6,319,044 B1 * 11/2001 Stekelenburg ..... 439/369
6,595,790 B1 * 7/2003 Bigotto ..... 439/157
6,682,361 B2 * 1/2004 Zweigle ..... 439/347
6,769,930 B1 * 8/2004 McDevitt, Jr. ..... 439/373
7,014,493 B1 * 3/2006 Battard ..... 439/373
7,029,302 B2 * 4/2006 Sawaya ..... 439/260
7,101,215 B2 * 9/2006 Woellner et al. ..... 439/371
7,140,903 B2 * 11/2006 Pulizzi et al. ..... 439/371
7,207,826 B1 * 4/2007 Yang ..... 439/373
7,232,330 B2 * 6/2007 Woellner et al. ..... 439/371
7,264,497 B1 * 9/2007 Lewis ..... 439/373
7,384,304 B1 * 6/2008 Fawcett ..... 439/567
7,513,791 B1 * 4/2009 Gary ..... 439/373
7,559,788 B2 * 7/2009 Legg ..... 439/373
7,722,380 B1 * 5/2010 West et al. ..... 439/373

(Continued)

*Primary Examiner* — Ross Gushi
(74) *Attorney, Agent, or Firm* — Raymond Y. Chan; David and Raymond Patent Firm

(57) ABSTRACT

A security device for a HDMI connector having a HDMI connector head provided on an electronic device having a HDMI socket. The security device includes a locking device including a locking head and a plurality of locker arms extended from two sides of the locking head respectively to define a locker channel for detachably receiving the HDMI connector head. Each of the locker arms has a plurality of engaging teeth formed therealong, wherein the locking device is arranged to operate between a locking mode and a releasing mode, wherein in the locking mode, the locker arms are inwardly pressed to bias against the HDMI connector head when the HDMI connector is plugged into the HDMI socket, wherein in the releasing mode, the locker arms are relieved from the pressing force so as to allow the HDMI connector head to be freely detached from the HDMI socket.

19 Claims, 7 Drawing Sheets

U.S. PATENT DOCUMENTS

| | | | | |
|---|---|---|---|---|
| 7,850,478 | B2 * | 12/2010 | Lin et al. | 439/373 |
| 7,857,654 | B2 * | 12/2010 | West et al. | 439/373 |
| 7,914,316 | B2 * | 3/2011 | D'Addario et al. | 439/362 |
| 8,029,308 | B2 * | 10/2011 | Saruwatari | 439/373 |
| 2003/0017738 | A1 * | 1/2003 | Zweigle | 439/347 |
| 2006/0046557 | A1 * | 3/2006 | Pulizzi et al. | 439/371 |
| 2006/0264087 | A1 * | 11/2006 | Woellner et al. | 439/371 |
| 2010/0248527 | A1 * | 9/2010 | West et al. | 439/371 |

* cited by examiner

SECURITY DEVICE FOR HDMI CABLE CONNECTOR

BACKGROUND OF THE PRESENT INVENTION

1. Field of Invention

The present invention relates to a security device, and more particularly to a security device for a HDMI cable connector which is capable of selectively locking the HDMI cable connector on an electronic device when it is connected to a HDMI socket provided thereon.

2. Description of Related Arts

A conventional High Definition Multimedia Interface (HDMI) cable connector comprises a HDMI connector head and a HDMI cable extended from the HDMI cable connector head, which is arranged to detachably insert into a HDMI socket provided on an electronic device, such as a LCD television. As a matter of conventional art, a majority of electronic devices which have a HDMI socket is very bulky and not meant to be easily portable. However, there exist a number of electronic devices which is small in size and is meant to be portable. Yet they have HDMI sockets provided thereon for receiving or outputting high definition video signals. For example, a digital camera may have a HDMI socket for outputting video having high definition quality. In addition, a portable surveillance monitor may also be equipped with a HDMI socket which is arranged to receive high definition video signal.

One disadvantage of conventional HDMI cable connector and conventional HDMI socket is that once the HDMI cable connector is connected to the HDMI socket, the connector may detach from the socket very easily. This disadvantage becomes very prevalent when the electronic devices concerned are meant to be portable. When the HDMI cable connector is accidentally detached from the HDMI socket, the user will suddenly lose video signal and the activity concerned must stop until the HDMI cable connector has reconnected to the HDMI socket.

SUMMARY OF THE PRESENT INVENTION

The invention is advantageous in that it provides a security device for a HDMI cable connector which is capable of selectively and effectively locking the HDMI cable connector on an electronic device when it is connected to a HDMI socket provided thereon.

Another advantage of the invention is to provide a security device for a HDMI cable connector which can be easily detached and attached onto the electronic device so that a user can be able to easily lock the HDMI cable connector on the electronic device when needed, while detaching the HDMI cable connector from the electronic device after it has been used.

Another advantage of the invention is to provide a security device for a HDMI cable connector which does not involve complicated mechanical or electrical structure so as to minimize the manufacturing cost of the present invention.

Another advantage of the invention is to provide a security device for a HDMI cable connector which does not substantially affect the original function and structure of the electronic device. As such, the present invention can be accepted and utilized widely.

Additional advantages and features of the invention will become apparent from the description which follows, and may be realized by means of the instrumentalities and combinations particular point out in the appended claims.

According to the present invention, the foregoing and other objects and advantages are attained by providing a security device for a HDMI cable connector having a HDMI connector head provided on an electronic device having a HDMI socket, wherein the security device comprises:

a locking device which is detachably mounted on the electronic device, and comprises:

a locking head; and a plurality of locker arms extended from two sides of the locking head respectively to define a locker channel for detachably receiving the HDMI connector head, wherein each of the locker arms has a plurality of engaging teeth formed therealong, wherein the locking device is arranged to operate between a locking mode and a releasing mode, wherein in the locking mode, the locker arms are inwardly pressed to bias against the HDMI connector head when the HDMI connector is plugged into the HDMI socket, wherein in the releasing mode, the locker arms are relieved from the pressing force so as to allow the HDMI connector head to be freely detached from the HDMI socket.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
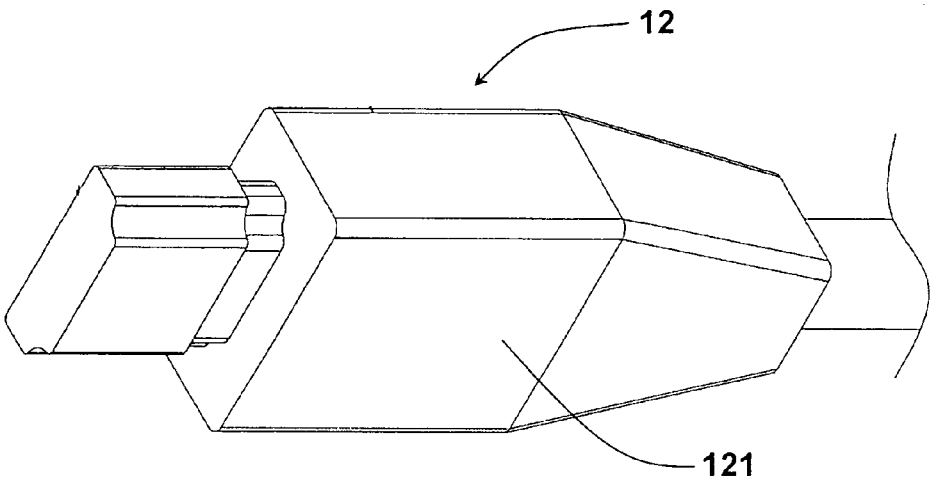
FIG. 1 is a schematic diagram of a HDMI cable connector according to a preferred embodiment of the present invention.

Referring to FIG. 1 to FIG. 7, FIG. 8A and FIG. 8B of the drawings, a security device according to a preferred embodiment of the present invention is illustrated. The security device is for a HDMI cable connector 12 having a HDMI connector head 121 provided on an electronic device 90 having a HDMI socket 11. The security device comprises a locking device 10.

The locking device 10 is detachably mounted on the electronic device 90, and comprises a locking head 101 and a plurality of locker arms 102. The locker arms 102 are extended from two sides of the locking head 101 respectively to define a locker channel 13 for detachably receiving the HDMI connector head 121, wherein each of the locker arms 102 has a plurality of engaging teeth 103 formed therealong. The locking device 10 is arranged to operate between a locking mode and a releasing mode, wherein in the locking mode, the locker arms 102 are inwardly pressed to bias against the HDMI connector head 121 when the HDMI connector 12 is plugged into the HDMI socket 11, wherein in the releasing mode, the locker arms 102 are relieved from the pressing force so as to allow the HDMI connector head 121 to be freely detached from the HDMI socket 11 and to prevent accidental detachment of the HDMI connector head 121 from the HDMI socket 11.

According to the preferred embodiment of the present invention, the security device is provided on the electronic device 90 which requires secure connection of between the HDMI cable connector 12 and the HDMI socket 11. The electronic device 90 can be a portable surveillance or other electronic devices. In this preferred embodiment, the security device is provided on a rear side of the electronic device 90.

Figure 4:
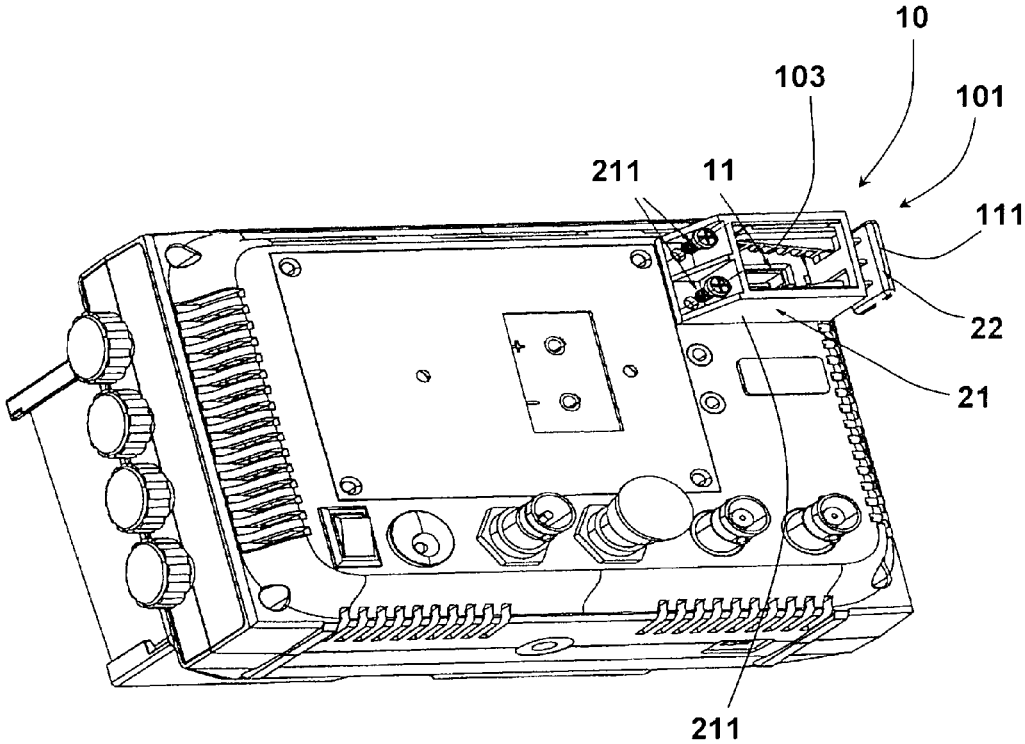
FIG. 4 is a second schematic diagram of the security device according to the above preferred embodiment of the present invention.
Figure 5:
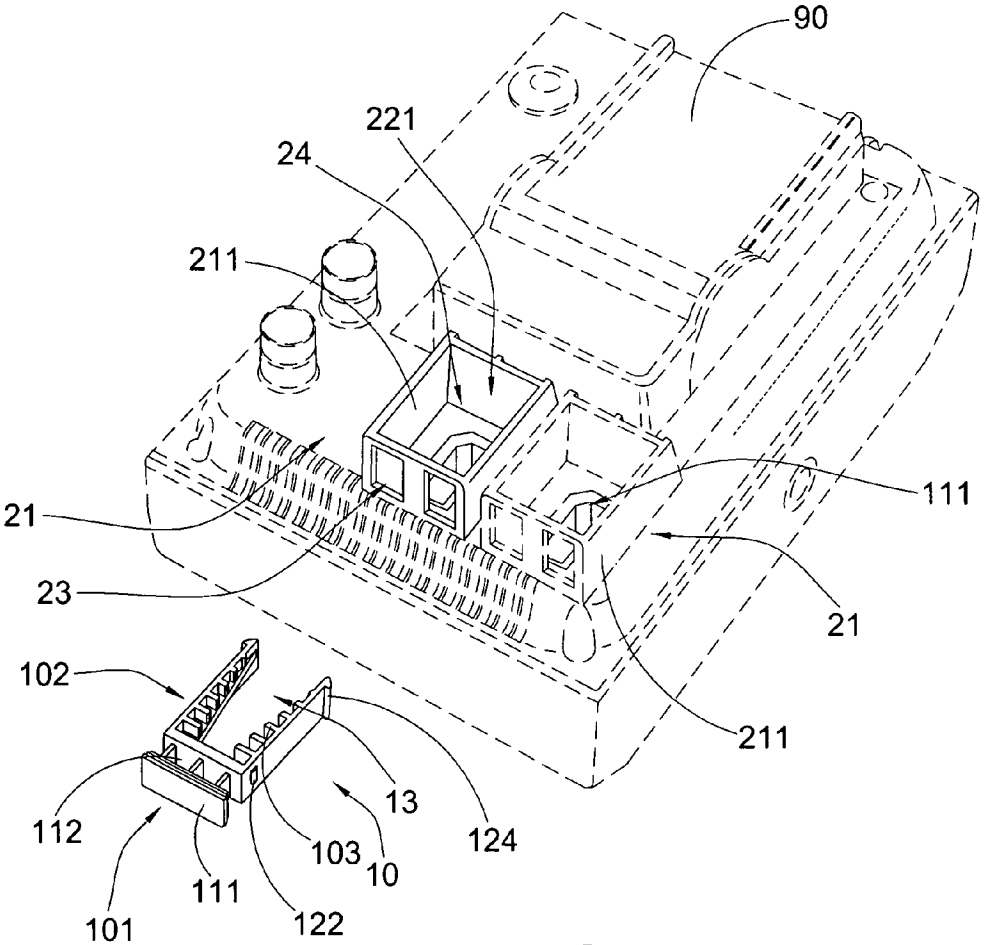
FIG. 5 is a perspective view of the security device according to the above preferred embodiment of the present invention.
Figure 6:
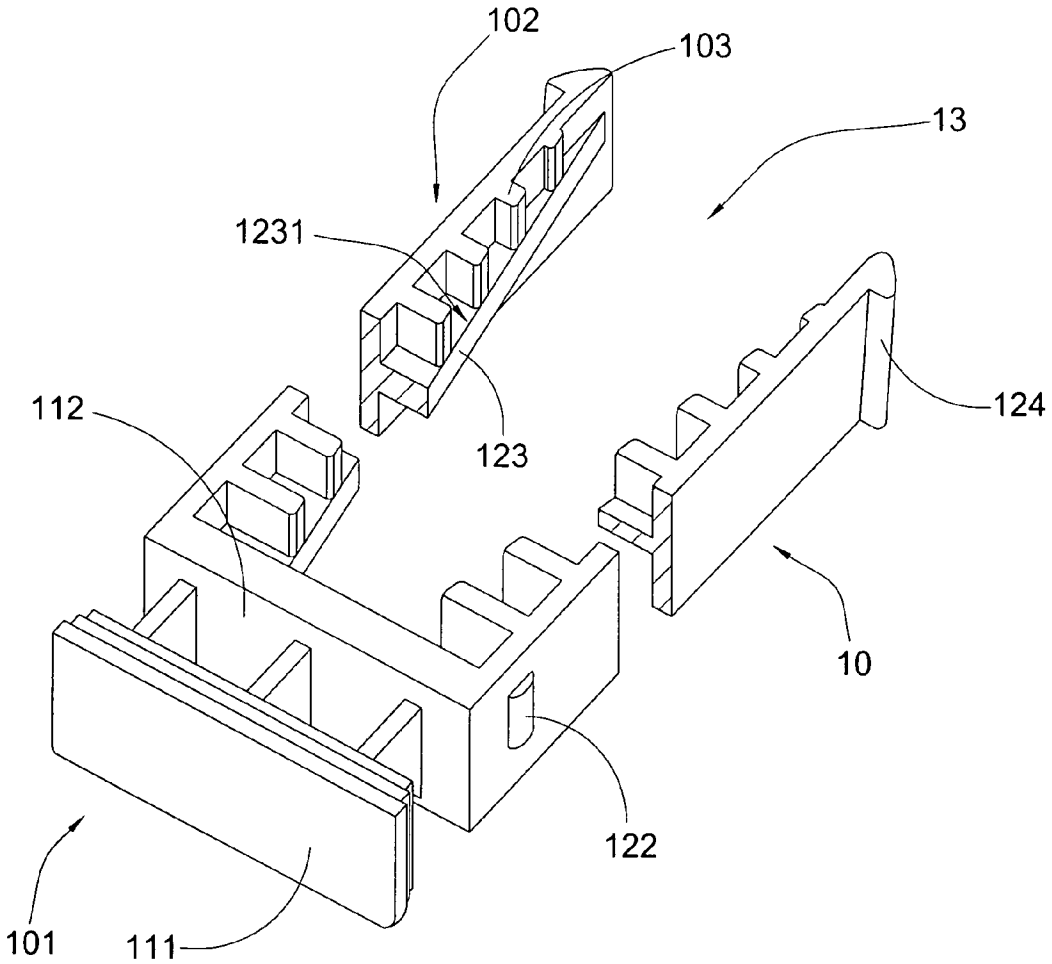
FIG. 6 is a third schematic view of the security device according to the above preferred embodiment of the present invention.
Figure 7:
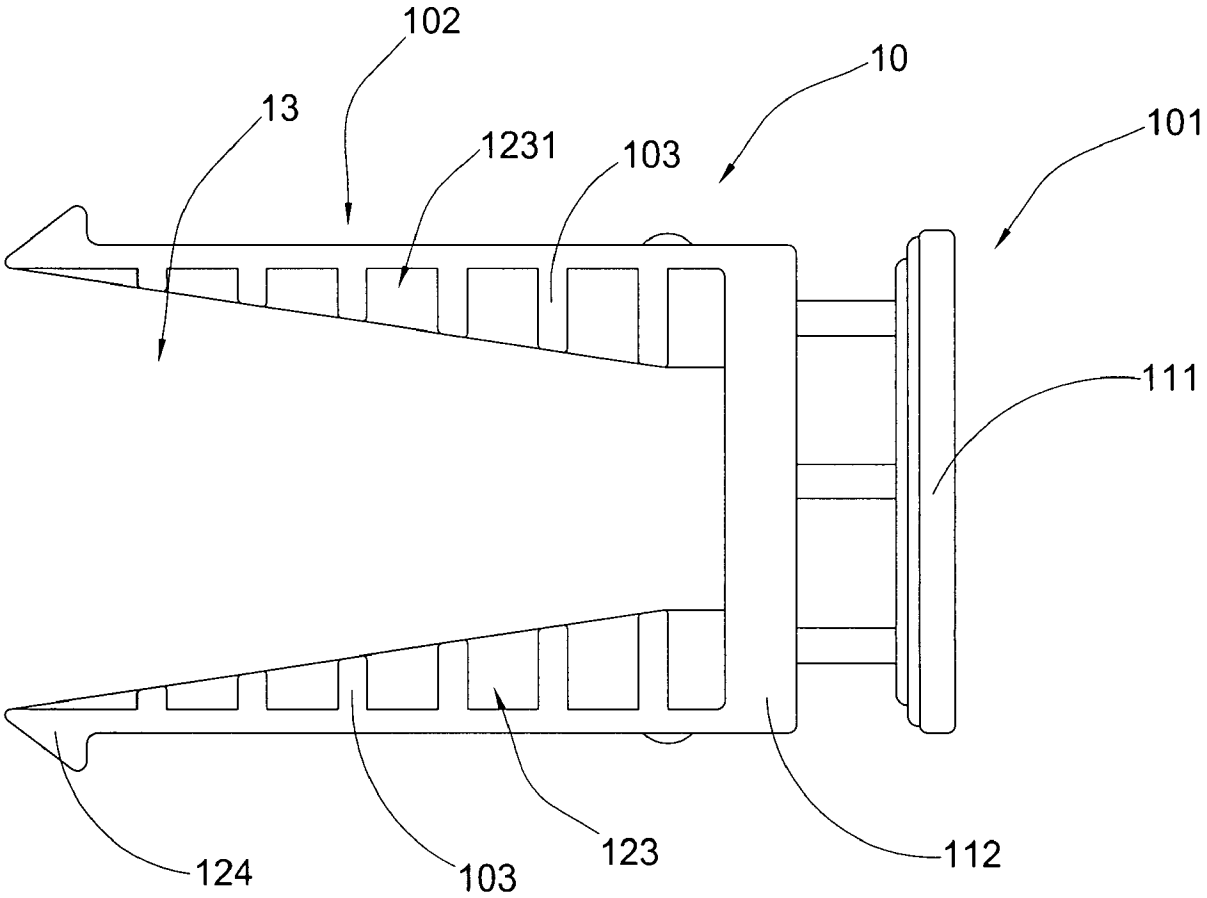
FIG. 7 is a second plan view of a security device according to the above preferred embodiment of the present invention.

The security device further comprises a security housing 21 which is provided on the rear side of the electronic device 90 at a position corresponding to that of the HDMI socket 11. The security housing 21 comprises a plurality of sidewalls 211 rearwardly extended from the rear side of the electronic device 90 to define a receiving cavity 24 between the sidewalls 211, and an access opening 221 communicating the receiving cavity 24 with an exterior of the security device. As shown in FIG. 4 of the drawings, the HDMI socket 11 is embedded within the receiving cavity 21.

The security housing 21 further has a plurality of locker slots 23 spacedly formed at one of the sidewalls 211 of the security housing 21 wherein each of the locker arms 102 is arranged to insert into the receiving cavity 24 through the corresponding locker slot 23. In other words, the locker arms 102 are arranged to insert into the locker slots 23 respectively for biasing against the HDMI connector head 121. Thus, a length of each of the locker slots 23 is slightly longer than a width of the corresponding locker arm 102 so as to allow easy insertion thereof.

Figure 2:
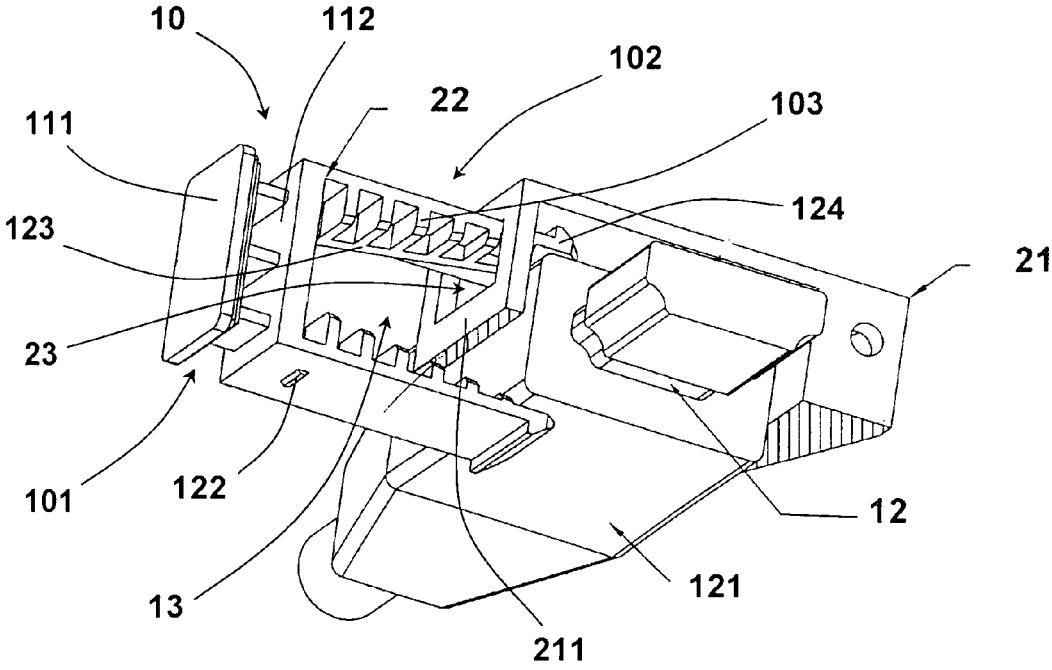
FIG. 2 is a first schematic view of a security device according to the above preferred embodiment of the present invention.
Figure 3:
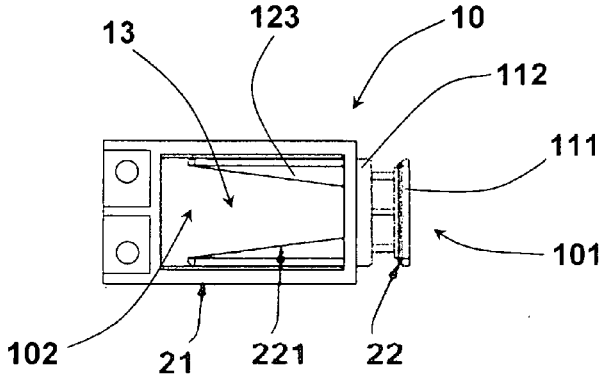
FIG. 3 is a first plan view of a security device according to the above preferred embodiment of the present invention.

The locking head 101 comprises a handle 111 and a locker panel 112 extended from the handle 111, and is aligned with the sidewall 211 having the locker slots 23 formed thereon. Thus, the locker panel 112 is arranged to bias against that corresponding sidewall 211 when the locker arms 102 are inserted into the locker slots 23 respectively so as to stop a further inward movement of the locking device 11. As shown in FIG. 1 to FIG. 3 of the drawings, the locker arms 102 are integrally extended from two sides of the locker panel 112 respectively for biasing against the HDMI connector head 121.

Furthermore, each of the locker arms 102 has a latch 122 protruded from an outer side of the corresponding locker arm 102 for engaging with a corresponding outer side edge of the corresponding locker slot 23. More specifically, each of the locker arms 102 has a predetermined elasticity in such a manner that when the locker arms 102 are being inserted into the locker slots 23, the latches 122 are arranged to elastically bias against an outer side of the sidewall 211. A user of the present invention is than able to exert a slight inward force to push the locker arms 102 into the locker slots 23. The locker arms 102 will then be slightly deformed (due to the predetermined elasticity) and pushed into the receiving cavity 24. After the latches 122 pass through the locker slots 23 respectively, the locker arms 102 resumes to their original shape and the latches 122 now bias against an inner side of the sidewall 211 at the outer edge of the locker slots 23 respectively. The result is that the locker arms 102 are prevented from moving out of the receiving cavity 24 unless a substantial pulling force is applied to the security device.

Moreover, each of the locker arms 102 further has a biasing ridge 123 protruded from an inner side of the locker arm 102 and is extended along a longitudinal direction thereof. Each of the biasing ridges 123 has a triangular cross section having a width gradually decreasing from the locker panel 112 to the other end of the locker arm 102. Thus, each of the biasing ridges 123 defines an engaging platform 1231 wherein the engaging teeth 103 are provided on the engaging platform 1231 for engaging with the HDMI connector head 121. The biasing ridges 123 are arranged to exert a biasing force toward the HDMI connector head 121 when the locker arms 102 are inserted into the locker slots 23 respectively.

In other words, the engaging teeth 103 are spacedly provided on the engaging platform 1231 from the locker panel 112 to the free end of the corresponding locker arm 102 at only one side of each of the locker arms 102 and at one side from the engaging platform 1231.

Each of the locker arms 102 further has an auxiliary latch 124 outwardly extended from the free end thereof, and is arranged to bias against the inner side of the sidewall 211 having the locker slots 23 when the locking device 10 is pulled to detach from the security housing 21. The auxiliary latch 124 also serves as a stopper of unwanted detachment of the locking device 10 for preventing accidental detachment thereof.

Figure 8A:
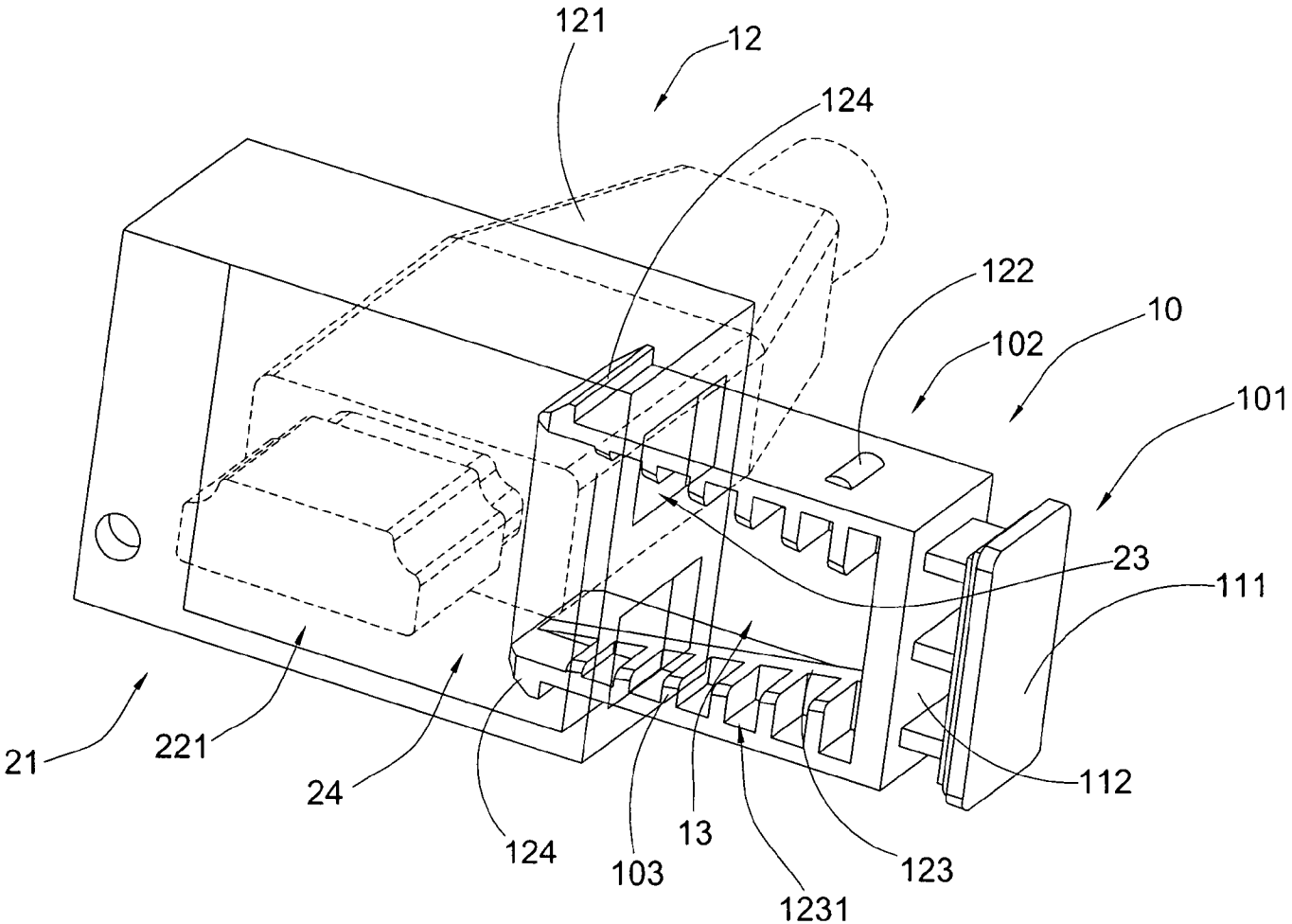
FIG. 8A and FIG. 8B are perspective views of the locking device of the security device according to the above preferred embodiment of the present invention, illustrating the security device is in a locking mode and the releasing mode respectively.
Figure 8B:
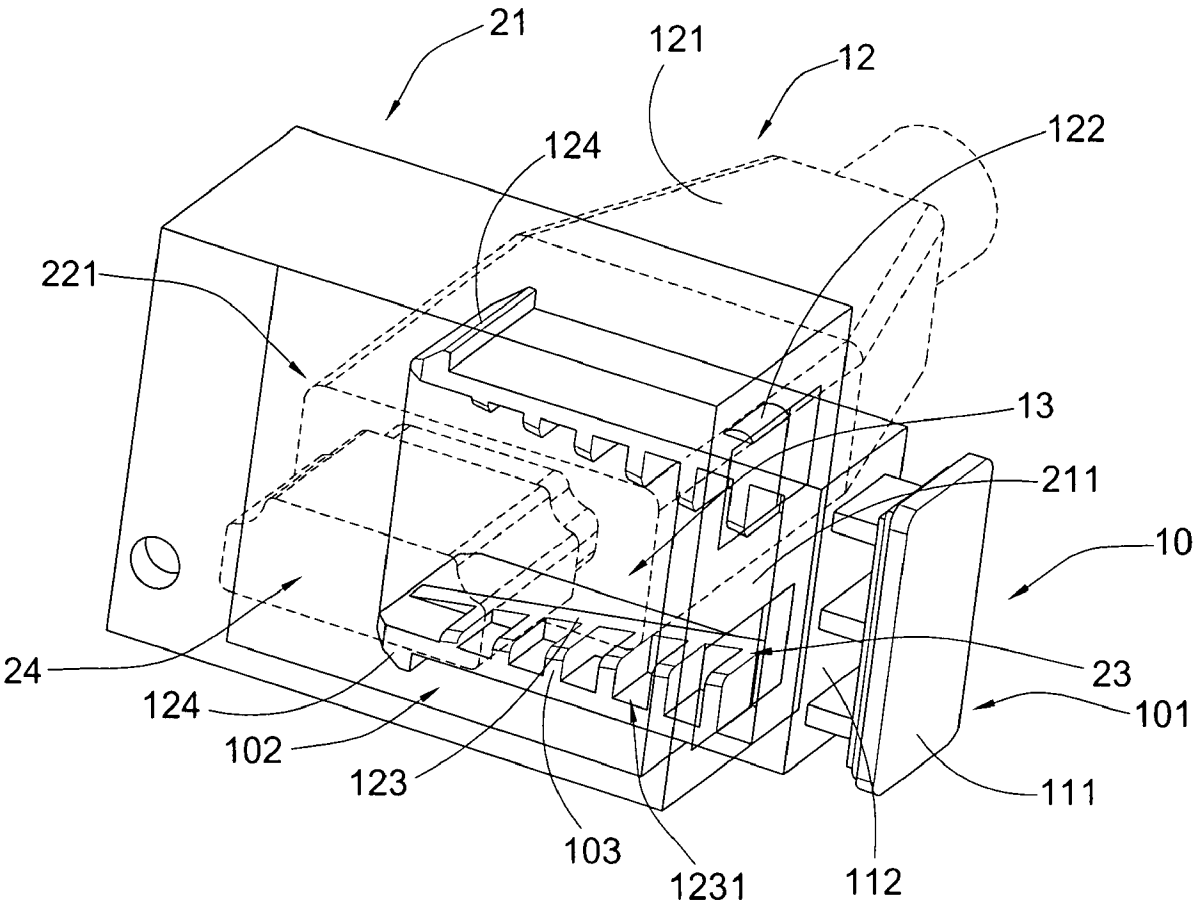

The operation of the present invention is as follows: as shown in FIG. 8A of the drawings, when a user wishes to use the security device for securing the HDMI connector head 121, he or she simply needs to connect the HDMI connector head 121 to the HDMI socket 11 of the electronic device 90. After that, the user needs to insert the locking device 10 into the security housing 21 for securing the HDMI connector head 121 to the HDMI socket 11 (as shown in FIG. 8B). When the user needs to detach the HDMI connector head 121 from the HDMI socket 11, he or she needs to detach the locking device 10 from the security housing 21 by exerting a predetermined amount of pulling force. After the locking device 10 is detached from the security housing 21, the HDMI connector head 121 can be easily unplugged from the HDMI socket 11.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A security device for a HDMI cable connector having a HDMI connector head provided on an electronic device having a HDMI socket, wherein said security device comprises:

a locking device which is detachably mounted on said electronic device, and comprises:

a locking head;

a plurality of locker arms extended from two sides of said locking head respectively to define a locker channel for detachably receiving said HDMI connector head, wherein each of said locker arms has a plurality of engaging teeth formed therealong, wherein said locking device is arranged to operate between a locking mode and a releasing mode, wherein in said locking mode, said locker arms are inwardly pressed to bias against said HDMI connector head when said HDMI connector is plugged into said HDMI socket, wherein in said releasing mode, said locker arms are relieved from said pressing force so as to allow said HDMI connector head to be freely detached from said HDMI socket;

a security housing which is provided on said electronic device at a position corresponding to that of said HDMI socket, wherein said security housing comprises a plurality of sidewalls rearwardly extended from said rear side of said electronic device to define a receiving cavity between said sidewalls, and an access opening communicating said receiving cavity with an exterior of said security device.

2. The security device, as recited in claim 1, wherein each of said locker arms further has a biasing ridge protruded from an inner side of said locker arm and is extended along a longitudinal direction thereof, wherein each of said biasing ridges has a triangular cross section having a width gradually decreasing from said locker panel to a free end of said locker arm.

3. The security device, as recited in claim 2, wherein each of said biasing ridges defines an engaging platform wherein said engaging teeth are provided on said engaging platform for engaging with said HDMI connector head, wherein said biasing ridges are arranged to exert a biasing force toward said HDMI connector head when said locker arms are inserted into said locker slots respectively.

4. The security device, as recited in claim 1, wherein said security housing further has a plurality of locker slots spacedly formed at one of said sidewalls of said security housing, wherein each of said locker arms is arranged to insert into said receiving cavity through said corresponding locker slot.

5. The security device, as recited in claim 4, wherein each of said locker arms has a latch protruded from an outer side of said corresponding locker arm for engaging with a corresponding outer side edge of said corresponding locker slot, wherein each of said locker arms has a predetermined elasticity such that when said locker arms are inserted into said locker slots, said latches are arranged to elastically bias against an outer side of said sidewall.

6. The security device, as recited in claim 4, wherein said locking head comprises a handle and a locker panel extended from said handle, and is aligned with said sidewall having said locker slots formed thereon, wherein said locker panel is arranged to bias against said corresponding sidewall when said locker arms are inserted into said locker slots respectively so as to stop a further inward movement of said locking device.

7. The security device, as recited in claim 6, wherein each of said locker arms further has a biasing ridge protruded from an inner side of said locker arm and is extended along a longitudinal direction thereof, wherein each of said biasing ridges has a triangular cross section having a width gradually decreasing from said locker panel to a free end of said locker arm.

8. The security device, as recited in claim 7, wherein each of said biasing ridges defines an engaging platform wherein said engaging teeth are provided on said engaging platform for engaging with said HDMI connector head, wherein said biasing ridges are arranged to exert a biasing force toward said HDMI connector head when said locker arms are inserted into said locker slots respectively.

9. The security device, as recited in claim 6, wherein each of said locker arms has a latch protruded from an outer side of said corresponding locker arm for engaging with a corresponding outer side edge of said corresponding locker slot, wherein each of said locker arms has a predetermined elasticity such that when said locker arms are inserted into said locker slots, said latches are arranged to elastically bias against an outer side of said sidewall.

10. The security device, as recited in claim 9, wherein each of said locker arms further has an auxiliary latch outwardly extended from said free end thereof, and is arranged to bias against said inner side of said sidewall having said locker slots when said locking device is pulled to detach from said security housing.

11. The security device, as recited in claim 9, wherein each of said locker arms further has a biasing ridge protruded from an inner side of said locker arm and is extended along a longitudinal direction thereof, wherein each of said biasing ridges has a triangular cross section having a width gradually decreasing from said locker panel to a free end of said locker arm.

12. The security device, as recited in claim 11, wherein each of said locker arms further has an auxiliary latch outwardly extended from said free end thereof, and is arranged to bias against said inner side of said sidewall having said locker slots when said locking device is pulled to detach from said security housing.

13. The security device, as recited in claim 11, wherein said locker arms are integrally extended from two sides of said locker panel respectively for biasing against said HDMI connector head.

14. The security device, as recited in claim 11, wherein each of said biasing ridges defines an engaging platform wherein said engaging teeth are provided on said engaging platform for engaging with said HDMI connector head, wherein said biasing ridges are arranged to exert a biasing force toward said HDMI connector head when said locker arms are inserted into said locker slots respectively.

15. The security device, as recited in claim 14, wherein said locker arms are integrally extended from two sides of said locker panel respectively for biasing against said HDMI connector head.

16. The security device, as recited in claim 14, wherein each of said locker arms further has an auxiliary latch outwardly extended from said free end thereof, and is arranged to bias against said inner side of said sidewall having said locker slots when said locking device is pulled to detach from said security housing.

17. The security device, as recited in claim 16, wherein a length of each of said locker slots is slightly longer than a width of said corresponding locker arm so as to allow easy insertion thereof.

18. The security device, as recited in claim 16, wherein said locker arms are integrally extended from two sides of said locker panel respectively for biasing against said HDMI connector head.

19. The security device, as recited in claim 18, wherein a length of each of said locker slots is slightly longer than a width of said corresponding locker arm so as to allow easy insertion thereof.

* * * * *